United States Patent [19]

Wunner

[11] Patent Number: 4,643,004

[45] Date of Patent: Feb. 17, 1987

[54] NEEDLE BAR OF A WARP KNITTING MACHINE

[75] Inventor: Roland Wunner, Bernstein, Fed. Rep. of Germany

[73] Assignee: Liba Maschinenfabrik GmbH, Fed. Rep. of Germany

[21] Appl. No.: 839,591

[22] Filed: Mar. 14, 1986

[30] Foreign Application Priority Data

Mar. 14, 1985 [DE] Fed. Rep. of Germany ..... 3509214

[51] Int. Cl.[4] ..... D04B 23/00

[52] U.S. Cl. ..... 66/208; 66/120; 66/123

[58] Field of Search ..... 66/120, 121, 123, 208

[56] References Cited

U.S. PATENT DOCUMENTS 2,129,327 9/1938 Kataja ..... 66/120

2,403,961 7/1946 Amidon ..... 66/208

*Primary Examiner*—Ronald Feldbaum

*Attorney, Agent, or Firm*—Anthony A. O'Brien

[57] ABSTRACT

A needle bar of a warp knitting machine, the needles of which comprise a needle shank bent at an angle, the bent portion of which is supported against a correspondingly shaped abutment on the needle bar. The bent portion bears against an end face of the needle bar with a face which extends substantially perpendicular to the direction of movement of the needle through the goods.

2 Claims, 2 Drawing Figures

NEEDLE BAR OF A WARP KNITTING MACHINE

Figure 1:
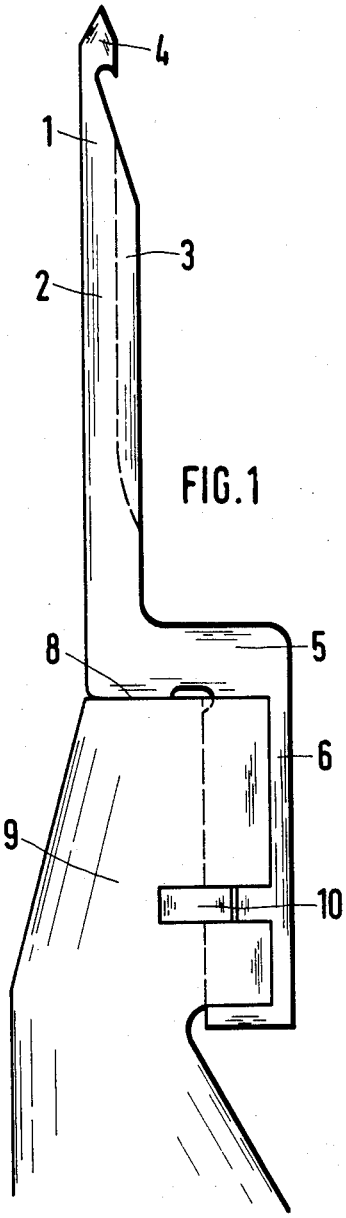

The invention relates to a needle bar of a warp knitting machine, the needles of which comprise a needle shank bent at an angle, the end of which needle shank is located in relation to the needle bar by a tongue-and-groove arrangement and the bent portion of which is supported against a correspondingly shaped abutment on the needle bar.

Such a needle bar is known from the DE-AS No. 1 287 248. This needle bar comprises, at its side adjacent to the needle shank, a bevel which supports the portion bent at an angle, likewise extending obliquely. This leads to the fact that an axial thrust acting on the needle, that is to say acting substantially in the direction of the needle shank, gives the needle the tendency to slide along the bevel of the needle bar and so to become loose in the attachment to the needle bar. Furthermore, it should be noted that stops extending obliquely, such as those represented by the said bevelling of a needle bar, involve difficulties when the accuracy requirements are high, because their angle has to be adhered to precisely. The accuracy requirements are particularly high in the case of a warp knitting machine because the heads of the needles must be in alignment with great accuracy in the longitudinal direction of the bar. A tendency towards inaccuracy then results through the bevel in so far as the bend at the point of transition from the bent portion of the needle shank to the end of the needle shank leads, in the event of deviations in length from one needle to another, immediately to a corresponding variation in the particular height of the needle head because of the bevel. In this case, the alignment of the needles is effected by two measures. On the one hand the end of the needle shank is located in relation to the needle bar by a tongue-and-groove arrangement, and on the other hand the bent portion lies in a slot in the needle bar. The end of the needle shank is not guided laterally. Thus the longitudinal alignment of the needle (in the sense of the perpendicularity of the longitudinal axis of the needle to the needle bar) is concentrated on the relatively short region of the bent portion provided with the slot, which cannot lead to any particular accuracy in the needle alignment.

In addition, a needle bar with needles is known from the DE-PS No. 2 655 269 wherein the needles are provided with portions bent at an oblique angle but without these bent portions being supported. Here the ends of the needle shanks are mounted entirely in slots in the needle bar while a location of the needles by a tongue-and-groove arrangement in the region of the end of the needle shank is additionally provided.

It is the object of the invention to avoid the above-mentioned disadvantages of the supporting of an angled portion extending obliquely and to form needle bar and needles so that they are well able to withstand axial thrust forces occurring in particular, without there being the tendency to displace the needles during the movement of the needle bar as a result of the form of needle bar and needle.

According to the invention, the problem is solved in that the end of the needle shank lies in a groove in the needle bar, in a manner known per se, and the bent portion bears against an end face of the needle bar with a face which extends substantially perpendicular to the direction of the movement of the needle through the goods.

The face which the needle is given in the region of its bent portion is in a position, because it is bearing against the end face extending substantially perpendicular to the direction of movement of the needle, to take up considerable axial thrust forces which, because of the substantially perpendicular direction of the said face, can be intercepted by this without producing a displacement component. In addition, the manufacture of the needle bar is facilitated because its front merely has to be given the substantially perpendicular end face.

If it is a question of a needle bar, the needles of which have a needle shank bent at an oblique angle, then provided between the bent portion and the needle bar there is a supporting portion which is made integral with the needle shank and bears against the end face of the needle bar.

Examples of embodiment of the invention are illustrated in the Figures.

Figure 2:
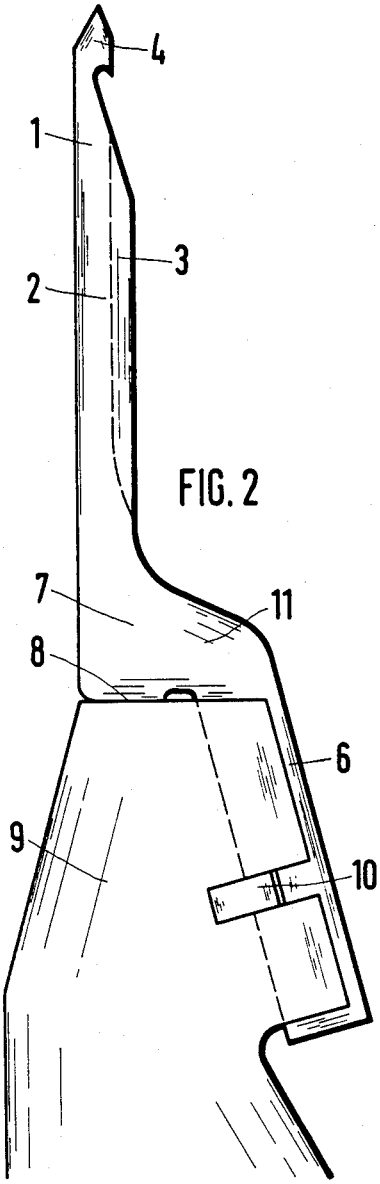

FIG. 1 shows a needle bar with needles which comprise a needle shank bent at right-angles, FIG. 2 shows a needle bar with needles which comprise a needle shank bent at an oblique angle.

In the example of embodiment shown in FIG. 1, it is a question of a compound needle. It is pointed out, however, that other forms of needle, for example latch needles, can be formed in the same way.

FIG. 1 shows the compound needle 1 with its needle shank 2 in which the groove 3 is milled for a slide bar, not illustrated. The needle shank 2 ends in the needle head 4. The needle shank 2 changes over, via the portion 5 bent at an angle, into the end 6 of the neeedle shank, the bent portion 5 bearing with its face adjacent to the needle bar 9 against the end face 8 of the needle bar 9. Thus this face and end face 8 have a direction which extends substantially perpendicular to the direction of movement of the needle 1 when this is passed through the goods for example. The forces acting on the needle shank 2 in the course of this are therefore taken up in a favourable manner by the end face 8 of the needle bar 9.

The end 6 of the needle shank is additionally located to a tongue 10 in relation to a corresponding groove in the needle bar 9, in known manner.

In the example of embodiment shown in FIG. 2, it is again a question of a compound needle 1 which, however, has a portion 11 bent at an oblique angle. With regard to the formation of the compound needle 1 and of the needle bar 9 otherwise, reference should be made to the explanation of FIG. 1.

According to FIG. 2, the bent portion 11 is provided, at its side remote from the groove 3, with the supporting portion 7 of triangular shape. The supporting portion 7, which is made integral with the bent portion 11, bears with its face extending substantially at right angles to the needle shaft 2 against the end face 8 of the needle bar 9 which extends in the same direction. Thus this end face 8 has a direction which extends substantially perpendicular to the direction of movement of the needle when this is passed through the goods for example. In addition, the supporting portion 7 gives the needle 1 a particular stability because stitches sliding off the needle shank 2, for example, which can exert a pull on the needle shank 2 in the direction away from the groove 3, cannot bend the needle shank 2 because the supporting portion 7, supported in relation to the end face 8, resists bending of the needle shank 2. This increase in stability also results in the example of embodiment shown in FIG. 1.

I claim:

1. A needle bar of a warp knitting machine, the needles of which comprise a needle shank bent at an angle, the end of which needle shank is located in relation to the needle bar by a tongue-and-groove arrangement and the bent portion of which is supported against a correspondingly shaped abutment on the needle bar, characterized in that the end (6) of the needle shank lies in a groove in the needle bar (9) in a manner known per se, and the bent portion (5) bears against an end face (8) of the needle bar (9) with a face which extends substantially perpendicular to the direction of the movement of the needle (1) through the goods.

2. A needle bar as claimed in claim 1, the needles of which comprise a needle shank bent at an oblique angle, characterised in that provided between the bent portion (11) and the neeedle bar (9) is a supporting portion (7) which is made integral with the needle shank (2) and which bears against the end faces (8) of the needle bar (9).

* * * * *